US008079505B2

(12) United States Patent
Leung

(10) Patent No.: US 8,079,505 B2
(45) Date of Patent: Dec. 20, 2011

(54) LOW-EFFORT, TWO-STAGE STAPLER

(75) Inventor: Chan Siu Leung, Kowloon (HK)

(73) Assignee: Tungk Yung International Limited, Kowloon (HK)

( * ) Notice: Subject to any disclaimer, the term of this patent is extended or adjusted under 35 U.S.C. 154(b) by 168 days.

(21) Appl. No.: 12/584,547

(22) Filed: Sep. 8, 2009

(65) Prior Publication Data

US 2010/0059568 A1 Mar. 11, 2010

(51) Int. Cl.
*B25C 5/11* (2006.01)

(52) U.S. Cl. ..... 227/132; 227/155; 227/156

(58) Field of Classification Search ..... 227/124, 227/128, 132, 155, 156, 151, 152, 153, 154, 227/30, 8
See application file for complete search history.

(56) References Cited

U.S. PATENT DOCUMENTS 5,758,813 A * 6/1998 Kikuchi et al. ..... 227/155
6,981,626 B1 * 1/2006 Tsai ..... 227/79
7,108,165 B2 * 9/2006 Tsai ..... 227/155
7,124,924 B2 * 10/2006 Marks ..... 227/120

* cited by examiner

*Primary Examiner* — Lindsay Low
*Assistant Examiner* — Nathaniel Chukwurah
(74) *Attorney, Agent, or Firm* — Thomas E. Schatzel, A Professional Corp.

(57) ABSTRACT

A stapler comprises an upper assembly for driving a staple through a stack of papers to be bound, and a lower assembly with a staple anvil for clinching the staples only after the staples are completely driven through the papers. The staple anvil is kept clear of the effort to drive in the staples by a risen table that is allowed to drop around the staple anvil in a second stage of operation. The upper assembly and a handle for the user are provided that are arranged to give the user a 2:1 mechanical advantage with a lever arrangement.

6 Claims, 4 Drawing Sheets

LOW-EFFORT, TWO-STAGE STAPLER

BACKGROUND OF THE INVENTION

1. Field of the Invention

Figure 1A:
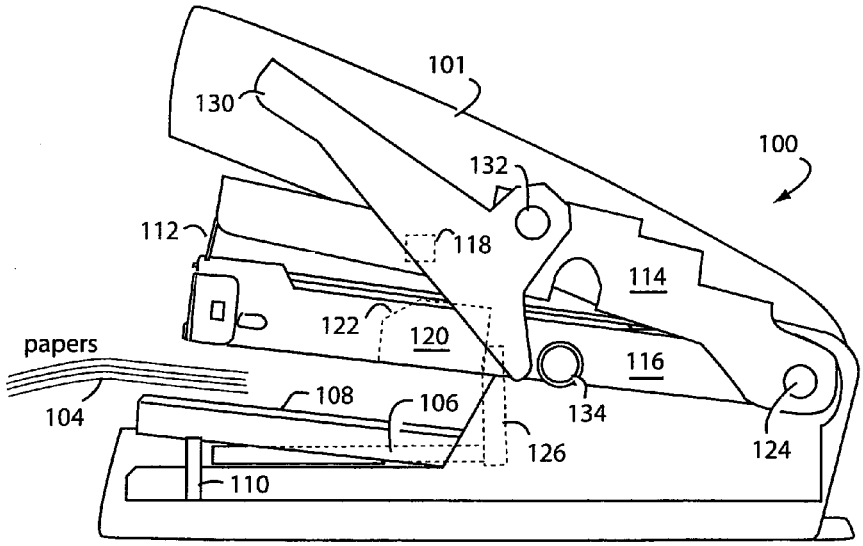

The present invention relates to staplers, and in particular to staplers that reduce staple mangling by driving the staples completely through first, and then folding over the ends with an anvil to clinch. It further relates to staplers in which a mechanical advantage is provided to reduce the effort needed by the users to bind papers together.

2. Description of the Prior Art

Conventional staplers sometimes need a lot of pressure applied by hand to bind a stack of papers together, and very often the staples crumple and don't penetrate. Very often this is because the staple anvil is directly underneath the papers and the staple must begin folding into a clinch before it has completely penetrated the top. Improved performance is acquired by first driving the staples completely through the stack, and then hammer the staple ends over with an anvil to clinch the binding.

SUMMARY OF THE INVENTION

Briefly, a stapler embodiment of the present invention comprises an upper assembly for driving a staple through a stack of material, e.g., papers to be bound, and a lower assembly with a staple anvil for clinching the staples only after the staples are completely driven through the stack. The staple anvil is kept clear of the effort to drive in the staples by a risen table that is allowed to drop around the staple anvil in a second stage of operation. The upper assembly and a handle for the user are provided that are arranged to give the user a 2:1 mechanical advantage with a lever arrangement.

These and other objects and advantages of the present invention will no doubt become obvious to those of ordinary skill in the art after having read the following detailed description of the preferred embodiments that are illustrated in the various drawing figures.

IN THE DRAWINGS

Figure 1B:
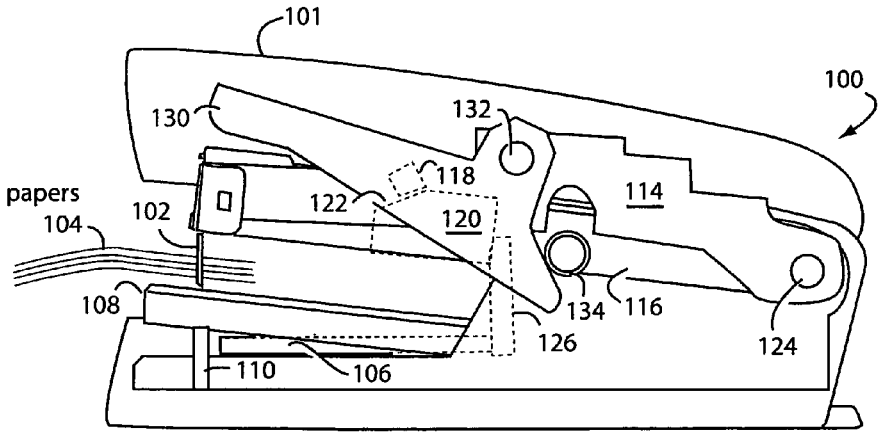
Figure 1C:
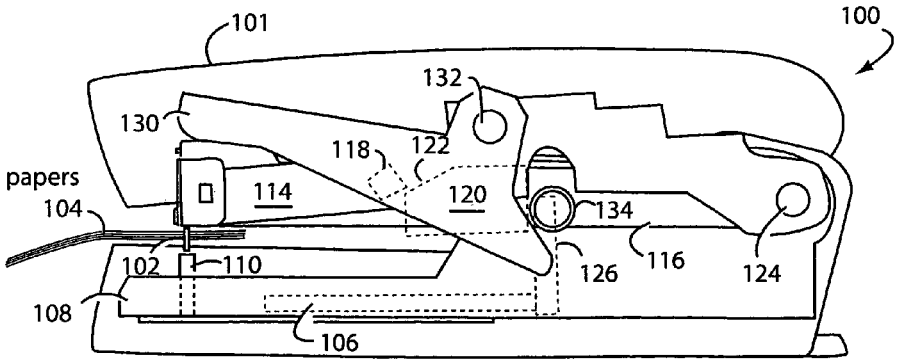
Figure 2:
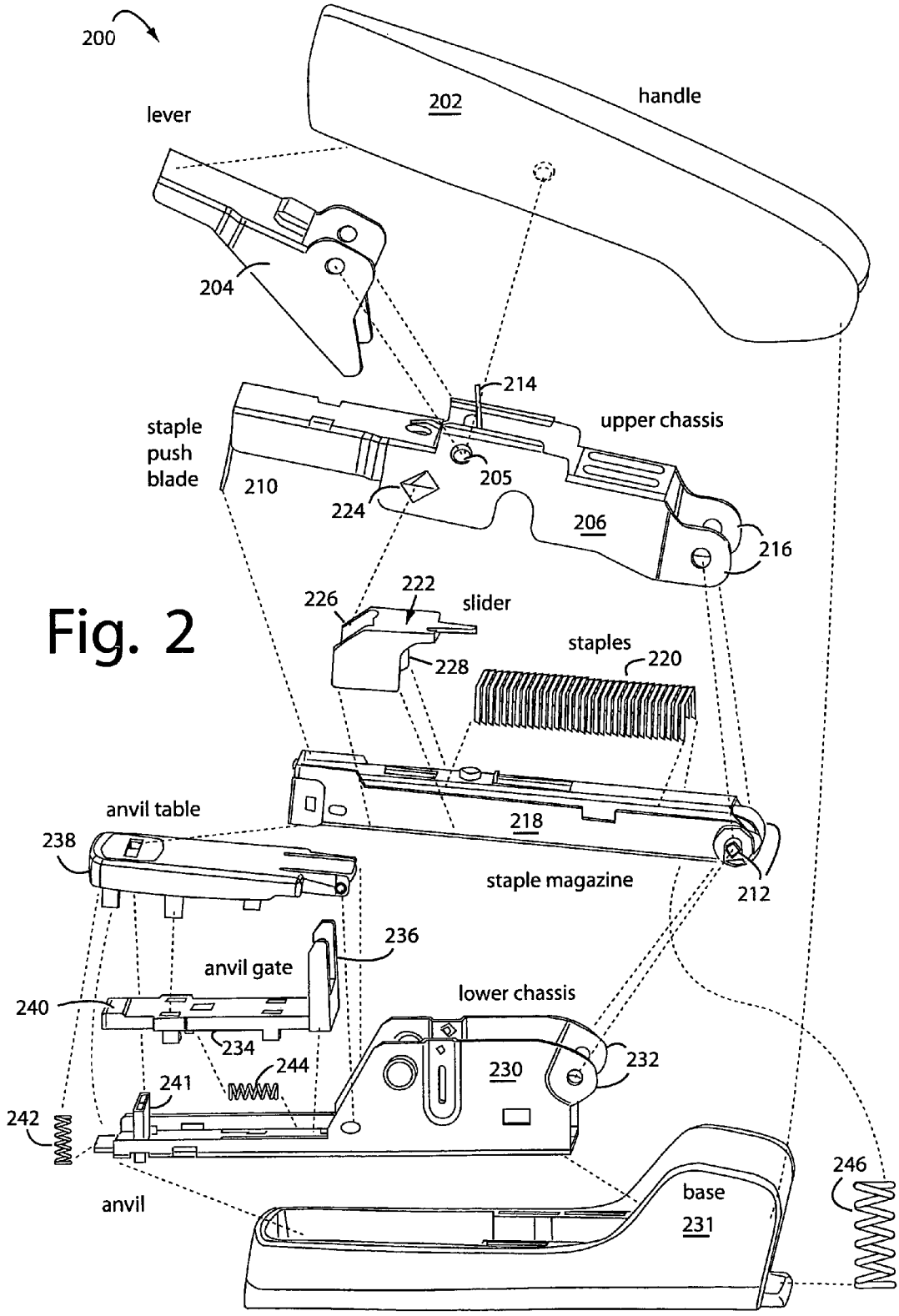

FIGS. 1A-1C are a series of side view diagrams of the operation of a stapler embodiment of the present invention, with FIG. 1A showing the internal workings are exposed and simplified in a relaxed state. FIG. 1B shows a staple fully driven into a workpiece. FIG. 1C shows the stapling being completed by an anvil hammering over and clinching the leg ends of a staple;

FIG. 2 is an exploded assembly view diagram of the stapler of FIGS. 1A-1C; and FIGS. 3A-3E show an upper left perspective view diagram, a left side diagram, a bottom view diagram, a front view diagram, and a rear view diagram, respectively, of the stapler shown in FIG. 2.

DETAILED DESCRIPTION OF THE PREFERRED EMBODIMENT

FIGS. 1A-1C provide an exposed view of the internal workings of a two-stage stapler embodiment of the present invention that is referred to herein by the general reference numeral 100. FIGS. 1A-1C are simplified somewhat, in order to show the operations more clearly. Other significant components, e.g., the springs necessary to return to a relaxed state, are shown in the assembly drawings of FIGS. 2-5.

FIG. 1A represents stapler 100 in a relaxed state. FIG. 1B shows a first stage of operation in which applying a user's hand pressure to a handle 101 drives a staple 102 all the way through material to be bound, e.g., paper sheets 104. FIG. 1C shows a second stage in which an anvil gate 106 slides back to allow anvil table 108 to drop around anvil 110. Anvil 110 can then hammer over and clinch the legs of staple 102, but only after staple 102 has completely penetrated paper sheets 104.

In the position shown in FIG. 1B, anvil gate 106 prevents anvil table 108 from dropping and it thereby provides support for paper sheets 104. Thus the pressure applied to staple 102 is used solely to drive staple 102 completely through paper sheets 104, and the legs of staple 102 enter a space in anvil table 108 above anvil 110. Such prevents crumpling and destruction of staple 102 by keeping the applied forces limited to that necessary to drive the staple through the paper sheets 104, and not to simultaneously clinch and fold the staple legs on the bottom side.

A staple push blade 112 at the distal end of an upper chassis 114 will push staple 102 down and out of a staple magazine 116. Staple 102 completely penetrates paper sheets 104 when upper chassis 114 has fully closed down around staple magazine 112 and staple push blade 112 has gone as far as it can go. At the appropriate moment when the staple 102 has fully penetrated paper sheets 104, anvil gate 106 is driven back to the rear by a cam mechanism, and the staple anvil 110 contacts the ends of staple 102.

The cam mechanism includes a pair of tabs 118 inside upper chassis 114 that come down against a sloped ram 120 on a slider 122 which rides on top of staple magazine 116, as in FIG. 1B. A rear main hinge 124 is common to both upper chassis 114 and staple magazine 116, so the two pivot relative to one another. The rearward movement of slider 122 continues, as in FIG. 1C, to engage upright arms 126 on anvil gate 106. Anvil gate 106 is pushed back inside anvil table 108 until a tongue at the end clears anvil 110. Anvil table 108 then drops allowing anvil 110 to contact the staple 102 and to hammer and clinch staple 102 about paper sheets 104 as pressure continues to be applied to handle 101.

Stapler 100 also uses the leverage principle to reduce effort required to operate, which reduction may be more than 50%, compared to conventional staplers. A lever 130 is provided with a fulcrum point 132, e.g., a pivot hinge made by flanging some holes outward on upper chassis 114. As the user presses down on handle 101, the long end of lever 130 is also pressed down. The short end of lever 130 engages a pair of holes 134 with flanges that protrude out from staple magazine 116. This arrangement provides a 2:1 mechanical advantage in the effort needed to squeeze upper chassis 114 and staple magazine 116 together to drive down staple 102 with staple push blade 112.

FIG. 2 represents how the pieces of a stapler 200 can be assembled together in an embodiment of the present invention that operates like that described in FIGS. 1A-1C. Stapler 200 comprises a handle 202 that fits over a lever 204 and upper chassis 206. Both the handle 202 and lever 204 attach at a pair of pivots 205 on opposite sides of an upper chassis 206. A staple push blade 210 is located at the distal end of upper chassis 206, opposite to a main rear hinge 212. A return spring 214 keeps the distal end of handle 202 up away from the long end of lever 204 when the stapler is released and not in use. A pair of hinge extensions 216 fit over opposite ends of main rear hinge 212 on staple magazine 218.

A stick of ordinary staples 220 may be loaded by a user in staple magazine 218. A slider 222 rides along the top of staple magazine 218, and is forward nearer staple push blade 210 until upper chassis 206 is compressed down over staple magazine 218. At that point, a pair of cam tabs 224 contact and push on a ramp face 226 on slider 222. Such action occurs when staple push blade 210 has fully descended through staple magazine 218 and fully pushed a staple into any papers being bound together.

A lower chassis 230 inside a base 231 has a pair of hinge extensions 232 that lock over main rear hinge 212. The whole upper assembly is therefore able to pivot on main rear hinge 212 when a user applies downward pressure at the end of handle 202. An anvil gate 234 is nested inside lower chassis 230 and can slide forward and back at the urging of slider 222. When a staple has been fully driven into the papers being bound, the rear faces 228 of slider 222 contact the fronts of two upright arms 236 on anvil gate 234 and push it back. The front end of an anvil table 238 is held aloft by a gate tongue 240 until anvil gate 234 is pushed back. When that happens, anvil table 238 is free to drop down around staple anvil 241. By then, the ends of a staple have fully penetrated the papers to be bound, and can be hammered over and clinched by bringing them into contact with staple anvil 241 as pressure continues to be applied to handle 202.

When stapler 200 is released, a spring 242 lifts up on the front edge of anvil table 238, another spring 244 pushes anvil gate 234 forward to lock anvil table 238 in its lifted state, and a main rear spring 246 pushes the upper assembly of staple magazine 218, upper chassis 206, and handle 202 open away from the bottom assembly so papers-to-be-stapled can be inserted.

Figure 3A:
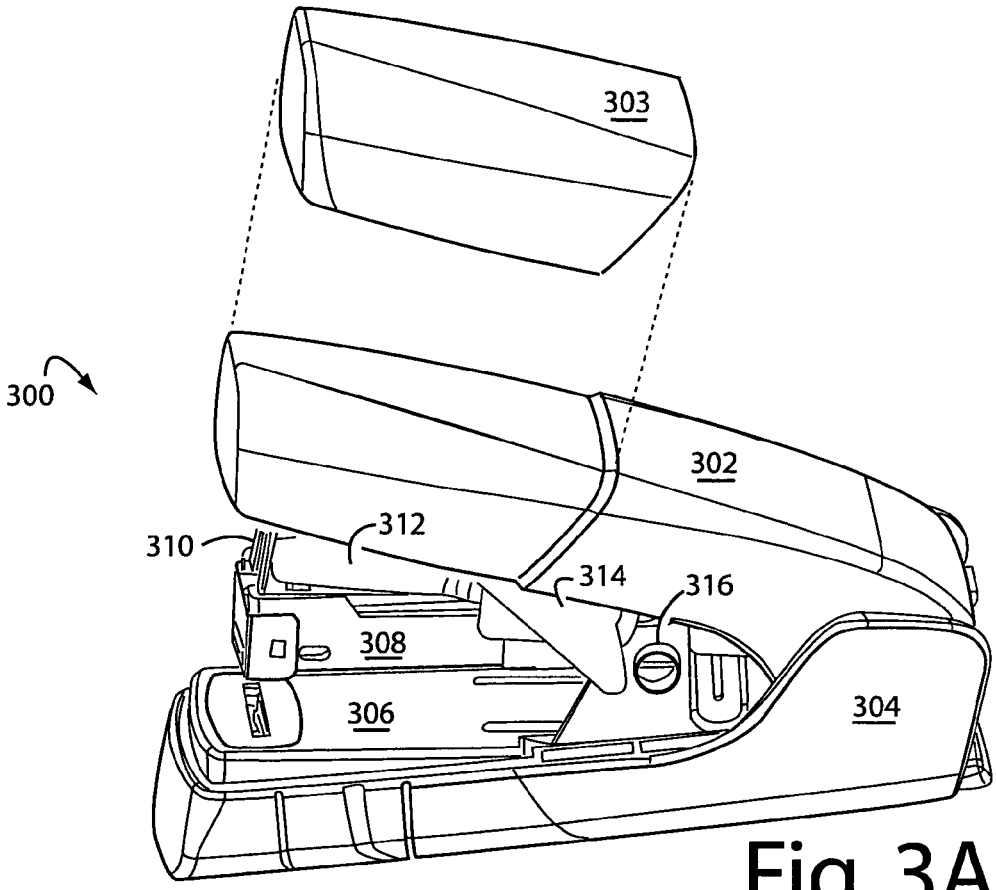
Figure 3B:
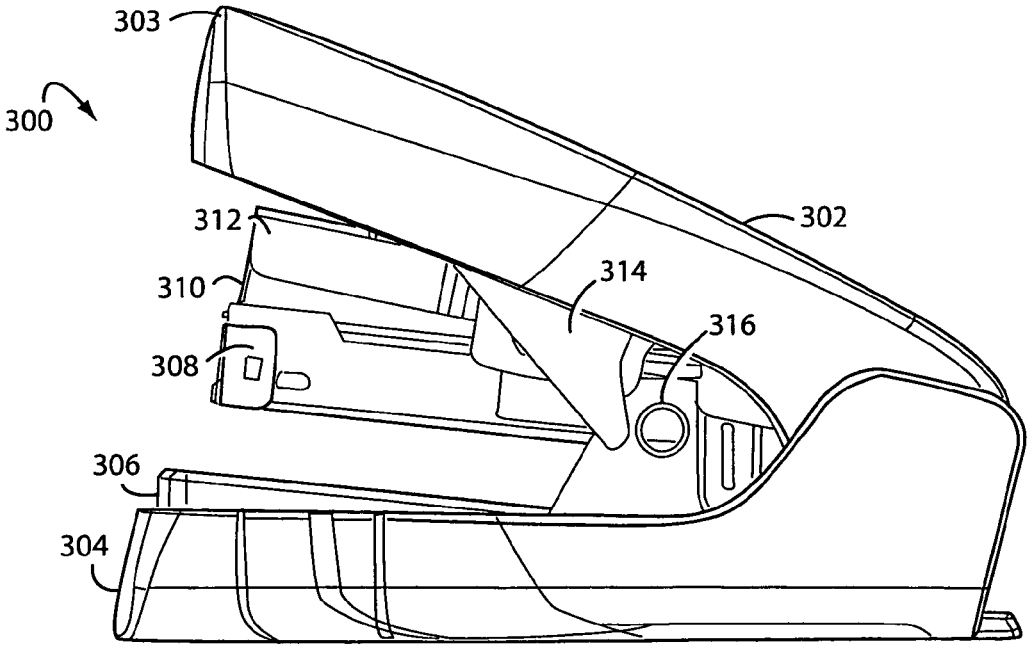

FIGS. 3A-3E show a stapler 300 in an embodiment of the present invention similar to staplers 100 and 200 of FIGS. 1A-1C and 2. As seen in FIGS. 3A-3B, stapler 300 includes a handle 302 and cover 303 on a base 304. An anvil table 306 rises up at the front out of base 304. A staple magazine 308 is loaded with conventional sticks of staples. A staple drive blade 310 at the front of an upper chassis 312 dives down into staple magazine 308 when a user applies downward pressure to handle 302. A lever 314 works against a pair deep flanges formed from a pair of holes 316 (only the left side can be seen in FIGS. 3A-3B) to provide a mechanical advantage and to assist the user when setting staples in workpieces.

If a cover 303 is used, it can be made of colored, transparent or translucent plastic to personalize or decorate stapler 300. Users can insert bits of paper or fabric beneath cover 303 that have graphics, text, or identification printed that will show through.

Figure 3C:
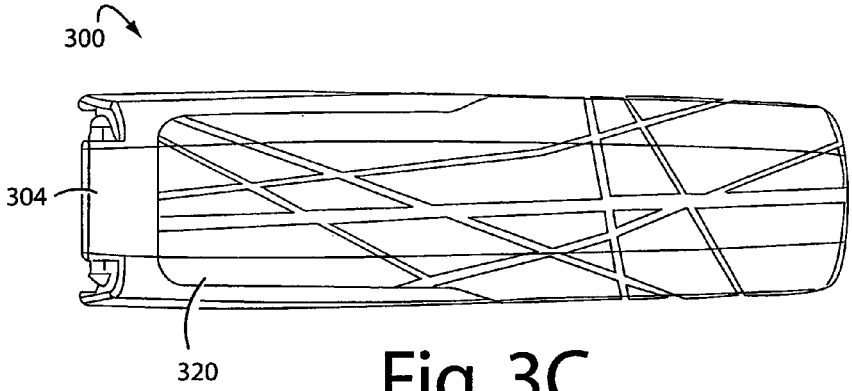
Figure 3D:
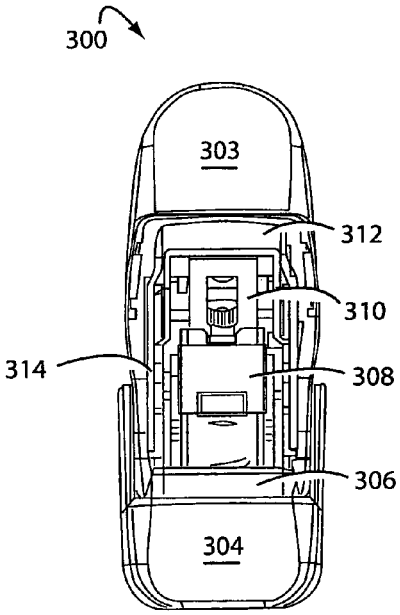
Figure 3E:
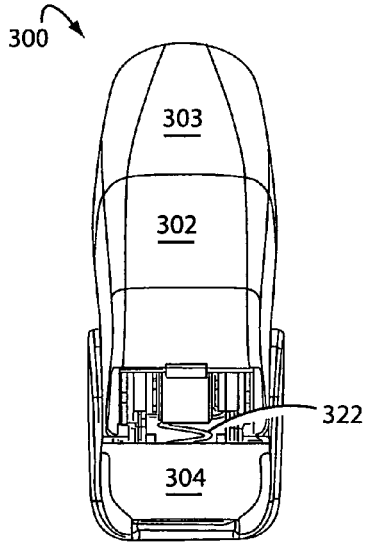

In FIG. 3C, a soft grip plate 320 can be seen attached to the bottom of base 304. A grip plate 320 of gum rubber provides a soft grip to prevent skidding of the stapler 300 on a tabletop. In FIG. 3D, stapler 300 is shown in a relaxed state, ready to staple a stack of paper sheets. Anvil table 306 is in its raised position and is locked. In FIG. 3E, a large return spring 322 at the rear is just visible through the back, and the same spring is represented as spring 246 in FIG. 2.

A portion, or all of handle 302 may be made of clear or translucent plastic such that colored and decorated Bristol paper may be included beneath to give the stapler 300 an attractive and fun appearance.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

The invention claimed is:

1. A stapler, comprising:

an upper assembly including a staple magazine hinged to an upper chassis with a staple push blade and providing for the dispensing of a staple into set of papers to be bound together;

a lower assembly including an anvil table that can rise up and lock above a staple anvil;

an anvil gate providing for the unlocking of said anvil table such that it can drop around said staple anvil when said upper chassis has been fully depressed onto said staple magazine by a user; and a cam tab and slider disposed in said upper chassis and staple magazine for translating a squeezing together of said upper chassis onto said staple magazine into a rearward motion that can unlock said anvil table and allow it to drop around said staple anvil.

2. The stapler of claim 1, further comprising:

a handle and a lever arranged for mechanical advantage and disposed in the upper assembly, and providing for reduced effort by said user to fully depress said upper chassis onto said staple magazine and thereby dispense said staple into said set of papers to be bound together.

3. A stapler, comprising:

an upper assembly including a staple magazine hinged to an upper chassis with a staple push blade and providing for the dispensing of a staple into set of papers to be bound together;

a lower assembly including an anvil table that can rise up and lock above a staple anvil;

an anvil gate providing for the unlocking of said anvil table such that it can drop around said staple anvil when said upper chassis has been fully depressed onto said staple magazine by a user;

a handle and a lever arranged for mechanical advantage and disposed in the upper assembly, and providing for reduced effort by said user to fully depress said upper chassis onto said staple magazine and thereby dispense said staple into said set of papers to be bound together;

a cam tab and slider disposed in said upper chassis and staple magazine for translating a squeezing together of said upper chassis onto said staple magazine into a rearward motion that can unlock said anvil table and allow it to drop around said staple anvil;

a mechanism for transitioning from said first stage of operation to said second stage of operation when a staple push blade has reached its maximum entry into a staple magazine; and a set of springs that return said anvil table to its risen position and that lock it there by pressing the anvil gate forward when the stapler is released by said user;

wherein, staples are completely into a workpiece in a first stage of operation, and said staples are clinched with a staple anvil in a second stage of operation, and said anvil table is locked over said staple anvil in said first stage of operation, and said anvil table down around said staple anvil in said second stage of operation; and wherein, crumpling of said staple is avoided by not clinching said staple until it has already been completely driven into said workpiece.

4. The stapler of claim 3, further comprising:

a removable cover that can snap onto the top of the handle to provide decoration or personalization.

5. A stapler, comprising:

an upper assembly including a staple magazine hinged to an upper chassis with a staple push blade and providing for the dispensing of a staple into set of papers to be bound together;

a lower assembly including an anvil table that can rise up and lock above a staple anvil;

an anvil gate providing for the unlocking of said anvil table such that it can drop around said staple anvil when said upper chassis has been fully depressed onto said staple magazine by a user; and a set of springs that return said anvil table to its risen position and that lock it there by pressing the anvil gate forward when the stapler is released by said user.

6. The stapler of claim 5, further comprising:

a handle and a lever arranged for mechanical advantage and disposed in the upper assembly, and providing for reduced effort by said user to fully depress said upper chassis onto said staple magazine and thereby dispense said staple into said set of papers to be bound together.

* * * * *